US006547582B2

(12) United States Patent
Matsuba et al.

(10) Patent No.: US 6,547,582 B2
(45) Date of Patent: Apr. 15, 2003

(54) LAMPHOLDER

(75) Inventors: Tetsuo Matsuba, Osaka (JP); Yoshinori Kakuno, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/870,356

(22) Filed: May 30, 2001

(65) Prior Publication Data

US 2001/0051465 A1 Dec. 13, 2001

(30) Foreign Application Priority Data

Jun. 7, 2000 (JP) ..... 2000-170136

(51) Int. Cl.[7] ..... H01R 4/50
(52) U.S. Cl. ..... 439/339; 439/86; 439/226
(58) Field of Search ..... 439/339, 419, 439/667, 619, 188, 340, 414, 86, 87, 226, 227, 228, 229, 230

(56) References Cited

U.S. PATENT DOCUMENTS 4,934,951 A * 6/1990 Schonath ..... 439/86
5,124,897 A * 6/1992 Kraus ..... 362/226
5,228,766 A * 7/1993 Makita et al. ..... 362/61
5,569,044 A * 10/1996 Huang ..... 439/340

* cited by examiner

*Primary Examiner*—Renee Luebke
*Assistant Examiner*—Phuongchi Nguyen
(74) *Attorney, Agent, or Firm*—Merchant & Gould, P.C.

(57) ABSTRACT

A lampholder for receiving a cap of a lamp includes a body, a receiving portion, and lead wires: the receiving portion is provided in the body and to be connected to the cap; the lead wires are connected to the receiving portion. The receiving portion is made of conductive resin. This configuration can reduce the parts, simplify assembly, lower the cost, and improve the productivity.

7 Claims, 9 Drawing Sheets

LAMPHOLDER

BACKGROUND OF THE INVENTION

1. Field of the Invention

The present invention relates to a lampholder.

2. Description of the Related Art

As shown in FIG. 9, a conventional lampholder includes a body 47, a female screw shell 48, a central contact spring 49, a cover 50, power terminal boards 52*a,* 52*b,* and lead wires 53*a,* 53*b.* The body 47 is made of insulating resin or ceramic and is in the form of a cylinder with the bottom. The female screw shell 48 is made of metal and connected electrically to a shell (not shown), e.g., of an E-type cap (not shown) for a lamp (not shown). Similarly, the central contact spring 49 is made of metal and connected electrically to an eyelet (not shown) of the cap. The cover 50 is made of insulating resin or ceramic and provided at the end of the body 47. The power terminal boards 52*a,* 52*b* are fastened on the inner surface of the cover 50 with a pair of screws 51 (one of them is not shown). The lead wires 53*a,* 53*b* are connected electrically to the power terminal boards 52*a,* 52*b.*

The body 47 and the cover 50 are connected mechanically with two screws 54*a,* 54*b.* One screw 54*a* mechanically connects the body 47 and the female screw shell 48, and also electrically connects the female screw shell 48 and the power terminal board 52*a.* The other screw 54*b* mechanically connects the body 47 and the central contact spring 49, and also electrically connects the central contact spring 49 and the power terminal board 52*b.*

A screw 55 is used to adjust the amount of movement of the central contact spring 49 when the cap is inserted. The screw 55 prevents the contact failure between the central contact spring 49 and the eyelet resulting from unnecessary movement of the central contact spring 49 toward the cover 50.

However, in the conventional lampholder, many screws or the like are necessary to fasten each part together, particularly, to fasten the component of resin or ceramic, such as the body 47, and that of metal, such as the female screw shell 48. This requires the steps of tightening those screws as well. In other words, the parts are increased and the process is complicated, which in turn increases the cost and reduces the productivity.

SUMMARY OF THE INVENTION

Therefore, with the foregoing in mind, it is an object of the present invention to provide a lampholder that can achieve the reduction of cost and the improvement of productivity by reducing the parts and simplifying the process.

A lampholder of the present invention for receiving a lamp cap includes a body, a receiving portion provided in the body and to be connected to the cap, and a lead wire connected to the receiving portion. The receiving portion is made of conductive resin.

Unlike a conventional lampholder, this configuration eliminates the need to fasten the component of resin or ceramic, such as a body, and that of metal, such as a female screw shell, together. Therefore, many screws or the like are not necessary. As a result, the parts can be reduced and the steps of tightening the screws or the like can be omitted. Thus, the reduction of cost as well as the improvement of productivity can be achieved.

These and other advantages of the present invention will become apparent to those skilled in the art upon reading and understanding the following detailed description with reference to the accompanying figures.

DESCRIPTION OF THE PREFERRED EMBODIMENTS

Hereinafter, embodiments of the present invention will be described with reference to the accompanying drawings.

Embodiment 1

Figure 1:
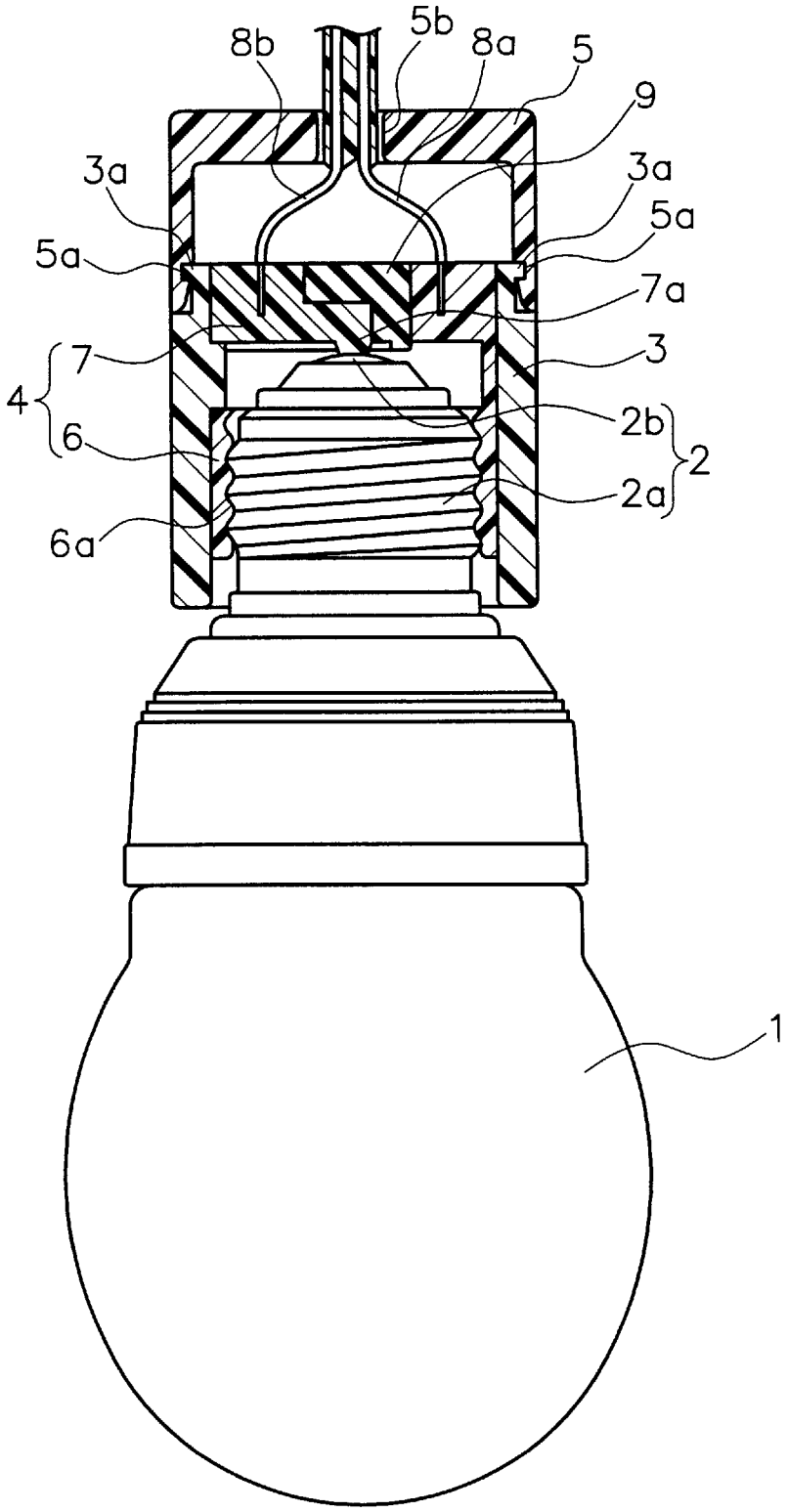
FIG. 1 is a cross-sectional front view showing a lampholder of Embodiment 1 of the present invention.

As shown in FIG. 1, an E-type cap 2 (e.g., E26-type), e.g., for a bulb-shaped fluorescent lamp 1 is inserted in a lampholder of Embodiment 1 of the present invention.

The lampholder includes a body 3, a receiving portion 4, and a cover 5. The body 3 is made of insulating resin and is in the form of a cylinder having a length of 35 mm, outer diameter of 35 mm, and inner diameter of 30 mm. The receiving portion 4 is made of conductive resin, provided on the inner surface of the body 3, and to be connected electrically to the cap 2. The cover 5 has a height of 15 mm and outer diameter of 35 mm, and is provided at the end of the body 3.

The body 3 and the receiving portion 4 are formed as an integral component.

The body 3 is connected to the cover 5 by engaging a convexity 3*a* at the end of the body 3 with a concavity 5*a* at the end of the cover 5.

Examples of the conductive resin used for the receiving portion 4 include a material prepared by mixing polybutylene terephthalate resin or polyphenylene sulfide resin with a conductive material, such as carbon black, metallic fiber, carbon fiber, metallic flakes, metallized glass beads, metallized glass fiber, and organic polymer.

The receiving portion 4 is provided with a first terminal 6 and a second terminal 7. The first terminal 6 has an internal thread 6*a* on the inner surface, into which a shell 2*a* of the cap 2, having an external thread, is screwed to establish the electrical connection between them. The second terminal 7 has a protruding contact portion 7*a* (with a protrusion length of 1 mm to 3 mm) that is connected electrically to an eyelet 2*b* at the end of the cap 2. The ends of the lead wires 8*a,* 8*b,* having a cross-sectional area of 0.75 $mm^2$ to 1.25 $mm^2$, are embedded directly in the first and the second terminals 6, 7, respectively, to establish the electrical connection. The length of the embedded portion of each lead wire 8*a*, 8*b* is 5 mm or more. The other ends of the lead wires 8*a*, 8*b* are drawn from a hole 5*b* in the center of the cover 5 to the outside of the lampholder. An insulating member 9 is provided between the first terminal 6 and the second terminal 7 to insulate the two terminals from one another.

Unlike a conventional lampholder, the above configuration of a lampholder of Embodiment 1 of the present invention eliminates the need to fasten the component of resin or ceramic, such as a body, and that of metal, such as a female screw shell, together. Therefore, many screws or the like are not necessary. As a result, the parts can be reduced significantly and the steps of tightening the screws or the like also can be reduced, compared with the conventional lampholder. Thus, the reduction of cost as well as the improvement of productivity can be achieved.

In particular, since the body 3 of insulating resin and the receiving portion 4 of conductive resin are formed as an integral component, the assembly of the body 3 and the receiving portion 4 can be omitted, thus increasing the productivity further.

Embodiment 2

Figure 2:
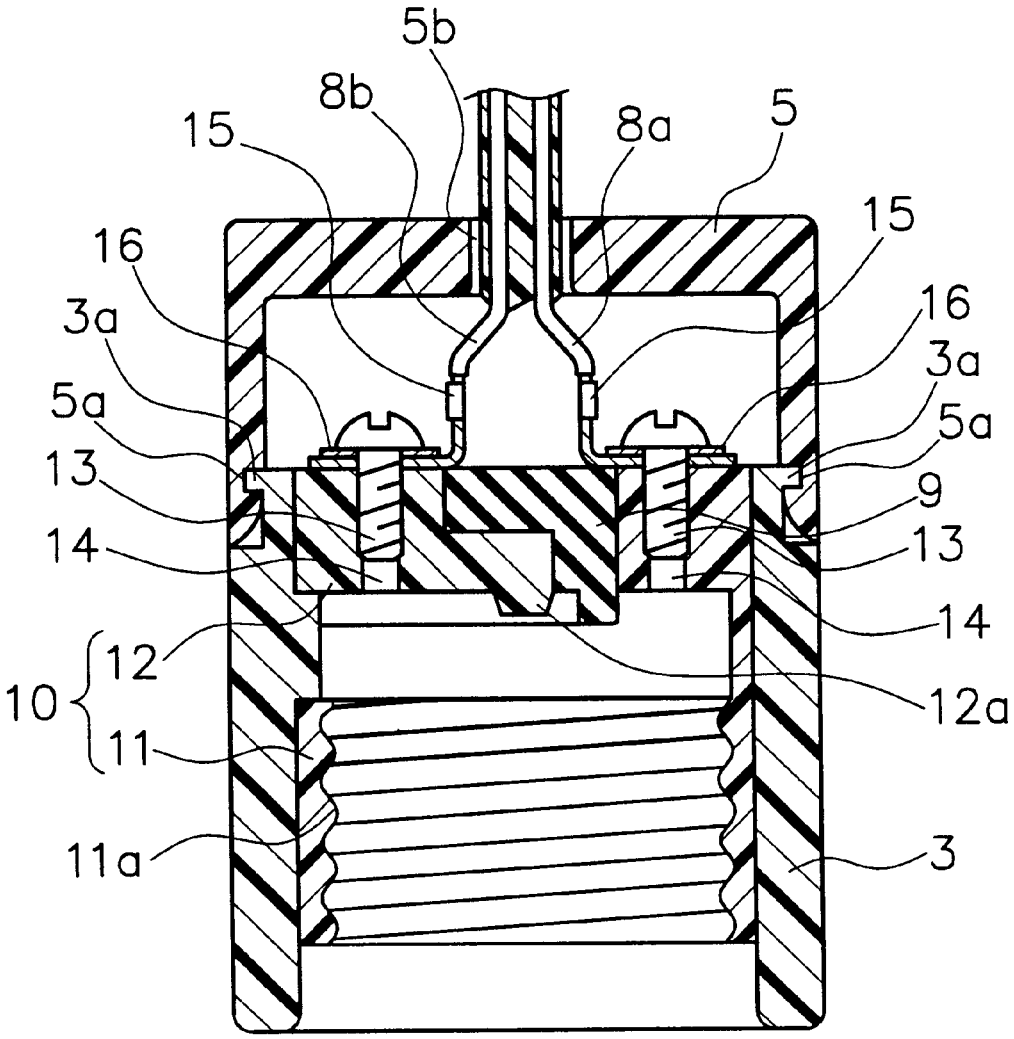
FIG. 2 is a cross-sectional front view showing a lampholder of Embodiment 2 of the present invention.

Next, a lampholder of Embodiment 2 of the present invention has the same configuration as that of a lampholder of Embodiment 1 of the present invention except that the structure of a receiving portion 10 and a means for connecting lead wires 8*a*, 8*b* and the receiving portion 10 are different, as shown in FIG. 2.

The receiving portion 10 is provided with a first terminal 11 and a second terminal 12. The first terminal 11 is made of conductive resin and has an internal thread 11*a* on the inner surface, into which a shell (not shown) of a cap (not shown), having an external thread, is screwed to establish the electrical connection between them. The second terminal 12 is made of conductive resin and has a protruding contact portion 12*a* (with a protrusion length of 1 mm to 3 mm) that is connected electrically to an eyelet (not shown) at the end of the cap. A body 3 and the receiving portion 10 are formed as an integral component.

An insulating member 9 is provided between the first terminal 11 and the second terminal 12 to insulate the two terminals from one another. Each of the first and the second terminals 11, 12 has a through hole 14 for screws so that a fastener 13 composed, e.g., of a tapping screw is driven into the hole.

The lead wire 8*a* is connected electrically to the first terminal 11 by fastening a pressure connector 15 with the fastener 13, the pressure connector 15 being connected to the end of the lead wire 8*a*.

Similarly, the lead wire 8*b* is connected electrically to the second terminal 12 by fastening a pressure connector 15 with the fastener 13, the pressure connector 15 being connected to the end of the lead wire 8*b*.

In FIG. 2, reference numeral 16 indicates a washer.

Unlike a conventional lampholder, the above configuration of a lampholder of Embodiment 2 of the present invention eliminates the need to fasten the component of resin or ceramic, such as a body, and that of metal, such as a female screw shell, together. Therefore, many screws or the like are not necessary. As a result, the parts and the steps of tightening the screws or the like can be reduced, compared with the conventional lampholder. Thus, the reduction of cost as well as the improvement of productivity can be achieved. In addition, the lead wires 8*a*, 8*b* can be removed from the lampholder easily, which facilitates the replacement of damaged parts caused, e.g., by disconnection of the lead wires 8*a*, 8*b*.

Embodiment 3

Figure 3:
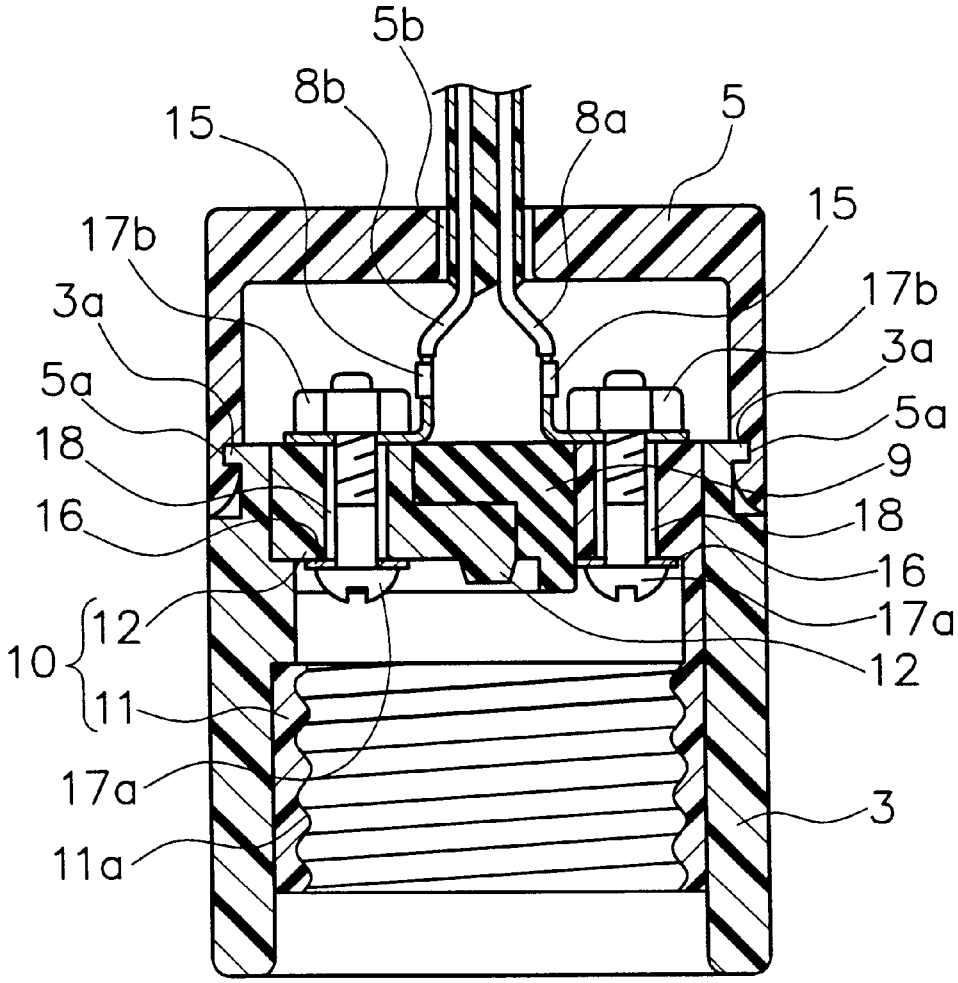
FIG. 3 is a cross-sectional front view showing a lampholder of Embodiment 3 of the present invention.

Next, a lampholder of Embodiment 3 of the present invention has the same configuration as that of a lampholder of Embodiment 2 of the present invention except that screws (fasteners 17*a* in FIG. 3) and nuts (fasteners 17*b* in FIG. 3) are used instead of tapping screws to connect a receiving portion 10 and lead wires 8*a*, 8*b* electrically, as shown in FIG. 3.

In FIG. 3, reference numeral 18 indicates a hole for screws.

Unlike a conventional lampholder, the above configuration of a lampholder of Embodiment 3 of the present invention eliminates the need to fasten the component of resin or ceramic, such as a body, and that of metal, such as a female screw shell, together, just as in the lampholder of Embodiment 2 of the present invention. Therefore, many screws or the like are not necessary. As a result, the parts and the steps of tightening the screws or the like can be reduced, compared with the conventional lampholder. Thus, the reduction of cost as well as the improvement of productivity can be achieved. In addition, the lead wires 8*a*, 8*b* can be removed from the lampholder easily, which facilitates the replacement of damaged parts caused, e.g., by disconnection of the lead wires 8*a*, 8*b*.

Embodiment 4

Figure 4:
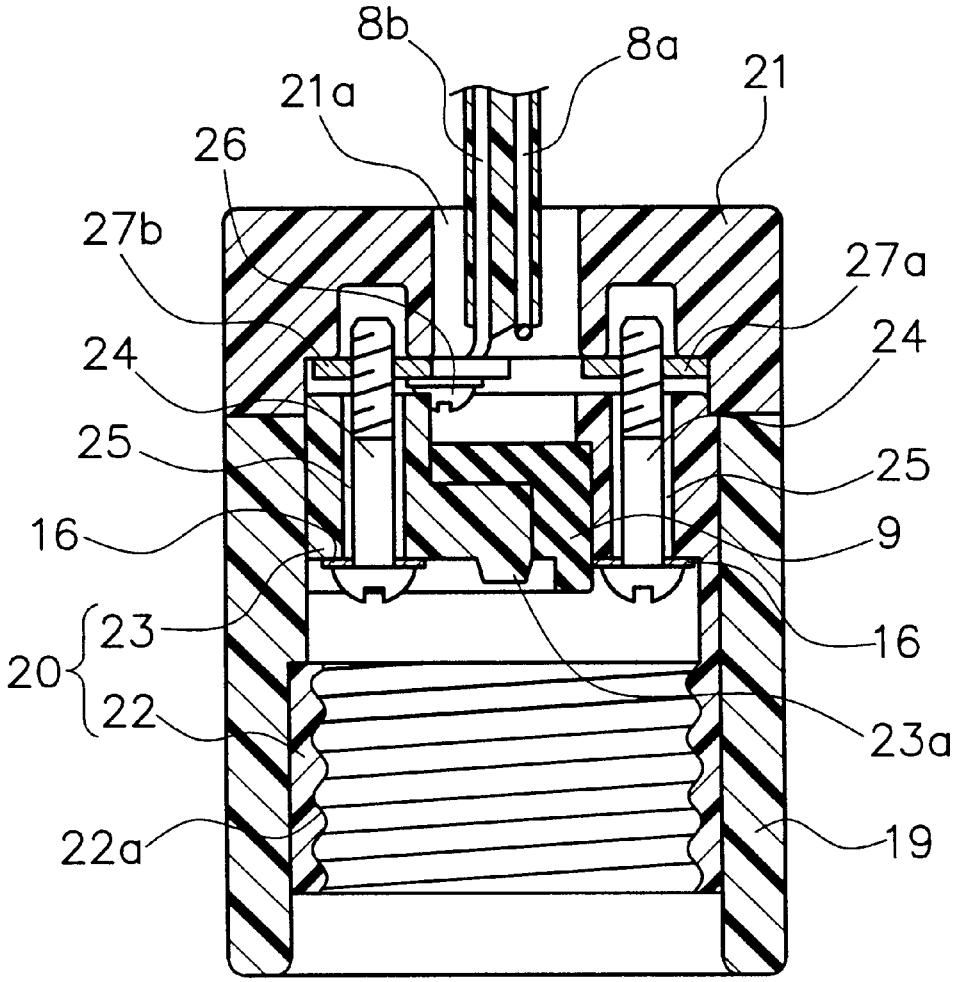
FIG. 4 is a cross-sectional front view showing a lampholder of Embodiment 4 of the present invention.

Next, a lampholder of Embodiment 4 of the present invention includes a body 19, a receiving portion 20, and a cover 21, as shown in FIG. 4. The body 19 is made of insulating resin and is in the form of a cylinder having a length of 35 mm, outer diameter of 35 mm, and inner diameter of 30 mm. The receiving portion 20 is made of conductive resin, provided on the inner surface of the body 19, and to be connected electrically to a cap (not shown). The cover 21 has a height of 15 mm and outer diameter of 35 mm, and is provided at the end of the body 19.

The body 19 and the receiving portion 20 are formed as an integral component.

The receiving portion 20 is provided with a first terminal 22 and a second terminal 23. The first terminal 22 has an internal thread 22*a* on the inner surface, into which a shell (not shown) of the cap, having an external thread, is screwed to establish the electrical connection between them. The second terminal 23 has a protruding contact portion 23*a* (with a protrusion length of 1 mm to 3 mm) that is connected electrically to an eyelet (not shown) at the end of the cap. Each of the first and the second terminals 22, 23 has a through hole 25 for screws so that a fastener 24 composed, e.g., of a screw is inserted into the hole. An insulating member 9 is provided between the first terminal 22 and the second terminal 23 to insulate the two terminals from one another.

The cover 21 has power terminal boards 27*a*, 27*b* on the inner surface, the power terminal boards 27*a*, 27*b* being connected electrically to the ends of the lead wires 8*a*, 8*b* by a pair of screws 26 (one of them is not shown). The other ends of the lead wires 8*a*, 8*b* are drawn from a hole 21*a* in the center of the cover 21 to the outside of the lampholder.

The first terminal 22 and the power terminal board 27*a* are connected electrically via the fastener 24. Similarly, the second terminal 23 and the power terminal board 27*b* are connected electrically via the fastener 24. Those fasteners 24 connect the body 19 and the cover 21 mechanically as well.

Unlike a conventional lampholder, the above configuration of a lampholder of Embodiment 4 of the present invention eliminates the need to fasten the component of resin or ceramic, such as a body, and that of metal, such as a female screw shell, together. Therefore, many screws or the like are not necessary. As a result, the parts and the steps of tightening the screws or the like can be reduced, compared with the conventional lampholder. In addition, the mechanical connection between the body 19 and the cover 21 and the electrical connection between the receiving portion 20 and the lead wires 8*a,* 8*b* can be made at the same time. Thus, the cost can be reduced and the productivity also can be increased further.

Embodiment 5

Figure 5:
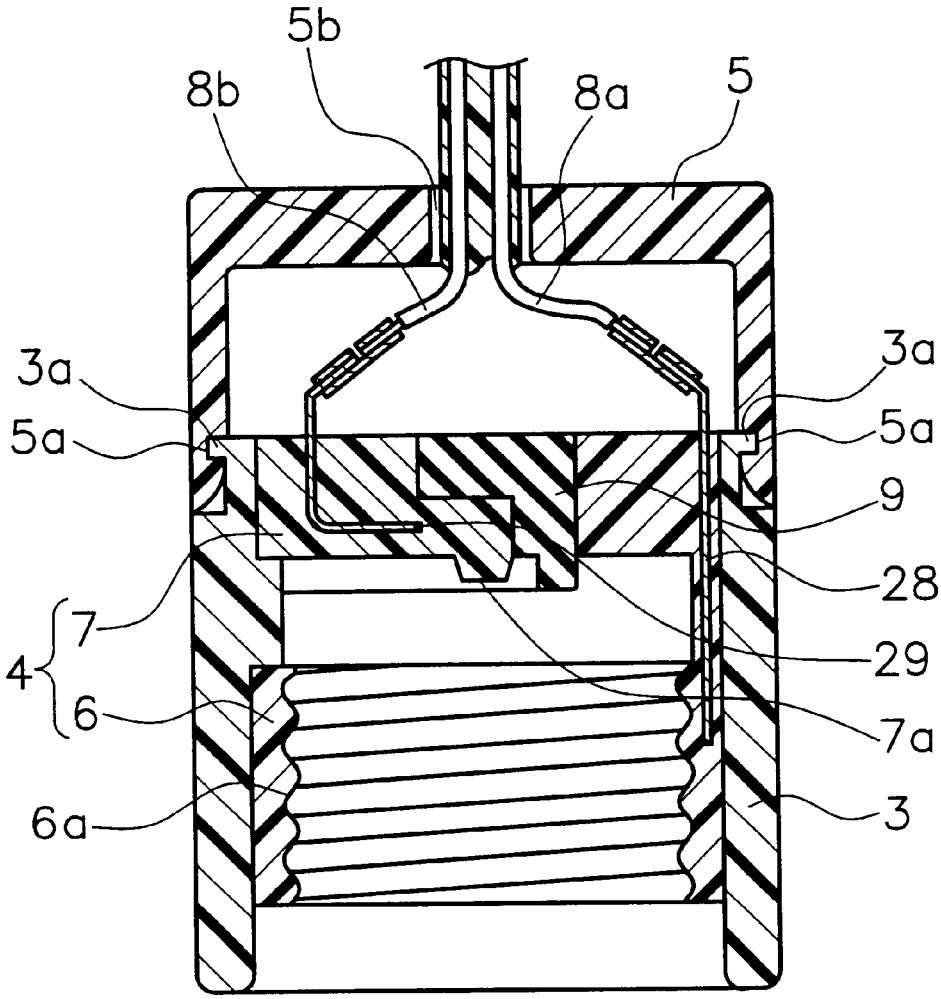
FIG. 5 is a cross-sectional front view showing a lampholder of Embodiment 5 of the present invention.

Next, a lampholder of Embodiment 5 of the present invention has the same configuration as that of a lampholder of Embodiment 1 of the present invention except that a receiving portion 4 and lead wires 8*a,* 8*b* are connected electrically via metallic terminals 28, 29 that are made of copper or brass and embedded in the receiving portion 4, as shown in FIG. 5.

The metallic terminal 28 is in the form of a plate having a length of 27 mm, width of 5 mm to 7 mm, and thickness of 0.1 mm to 1.0 mm. The length of the embedded portion of the metallic terminal 28 in a first terminal 6 is 20 mm. On the other hand, the metallic terminal 29 is in the form of a plate having a length of 20 mm, width of 5 mm to 7 mm, and thickness of 0.1 mm to 1.0 mm and is bent to have an L shape. The length of the embedded portion of the metallic terminal 29 in a second terminal 7 is 13 mm.

The lead wires 8*a,* 8*b* are connected electrically to the metallic terminals 28, 29, respectively, by caulking.

Unlike a conventional lampholder, the above configuration of a lampholder of Embodiment 5 of the present invention eliminates the need to fasten the component of resin or ceramic, such as a body, and that of metal, such as a female screw shell, together. Therefore, many screws or the like are not necessary. As a result, the parts and the steps of tightening the screws or the like can be reduced, compared with the conventional lampholder. Thus, the reduction of cost as well as the improvement of productivity can be achieved. In addition, since the receiving portion 4 and the lead wires 8*a,* 8*b* are connected electrically via the metallic terminals 28, 29, the operation of connecting the receiving portion 4 and the lead wires 8*a,* 8*b* can be performed easily.

In particular, the metallic terminal 29 is bent to have an L shape, thereby preventing it from slipping off the receiving portion 4 (the second terminal 7).

Example 6

Figure 6:
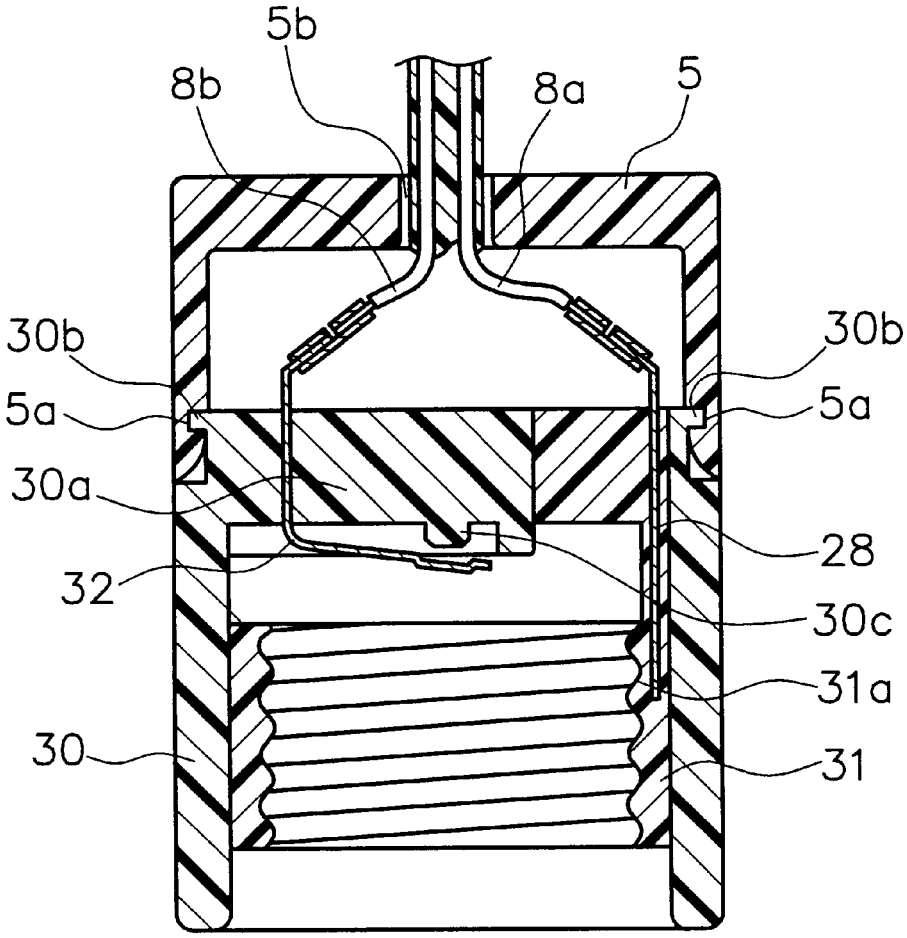
FIG. 6 is a cross-sectional front view showing a lampholder of Embodiment 6 of the present invention.

Next, a lampholder of Embodiment 6 of the present invention includes a body 30, a first terminal 31, a central contact spring 32, and a cover 5, as shown in FIG. 6. The body 30 is made of insulating resin and is in the form of a cylinder with the bottom, having a total length of 35 mm, outer diameter of 35 mm, and inner diameter of 30 mm. The first terminal 31 is made of conductive resin and provided on the inner surface of the body 30. Also, the first terminal 31 has an internal thread 31*a* on the inner surface, into which a shell (not shown) of a cap (not shown), having an external thread, is screwed to establish the electrical connection between them. The central contact spring 32 is made of copper or brass, has an L shape, length of 32 mm, width of 5 mm to 7 mm, and thickness of 0.2 mm to 1.0 mm, and is connected electrically to an eyelet (not shown) at the end of the cap. The cover 5 has a height of 15 mm and outer diameter of 35 mm, and is provided on a bottom 30*a* of the body 30.

The body 30 and the first terminal 31 are formed as an integral component.

The cover 5 is connected to the body 30 by engaging a concavity 5*a* at the end of the cover 5 with a convexity 30*b* at the bottom 30*a* of the body 30.

A metallic terminal 28 in the form of a plate having a length of 27 mm, width of 5 mm to 7 mm, and thickness of 0.1 mm to 1.0 mm is embedded in the first terminal 31 to establish the electrical connection between them. The length of the embedded portion of the metallic terminal 28 is 20 mm. Also, the metallic terminal 28 is connected electrically to a lead wire 8*a* by caulking, the lead wire 8*a* being drawn from a hole 5*b* in the center of the cover 5 to the outside of the lampholder. In other words, the lead wire 8*a* and the first terminal 31 are connected electrically via the metallic terminal 28.

The bottom 30*a* of the body 30 holds the central contact spring 32, which penetrates the bottom 30*a*. One end of the central contact spring 32 is connected electrically to a lead wire 8*b* by caulking. When a cap is inserted in the lampholder, the other end of the central contact spring 32 is pushed toward the cover 5 into contact with a projection 30*c* at the center of the bottom 30*a* of the body 30 and is connected electrically to the eyelet of the cap. In this case, force acts to move the other end of the central contact spring 32 back to the cap side, so that the electrical connection between the central contact spring 32 and the eyelet can be established reliably.

Unlike a conventional lampholder, the above configuration of a lampholder of Embodiment 6 of the present invention eliminates the need to fasten the component of resin or ceramic, such as a body, and that of metal, such as a female screw shell, together. Therefore, many screws or the like are not necessary. As a result, the parts and the steps of tightening the screws or the like can be reduced, compared with the conventional lampholder. Thus, the reduction of cost as well as the improvement of productivity can be achieved. In addition, the central contact spring 32 of metal is used to make the electrical connection with the eyelet, thereby decreasing contact failure and increasing reliability.

Embodiment 7

Figure 7:
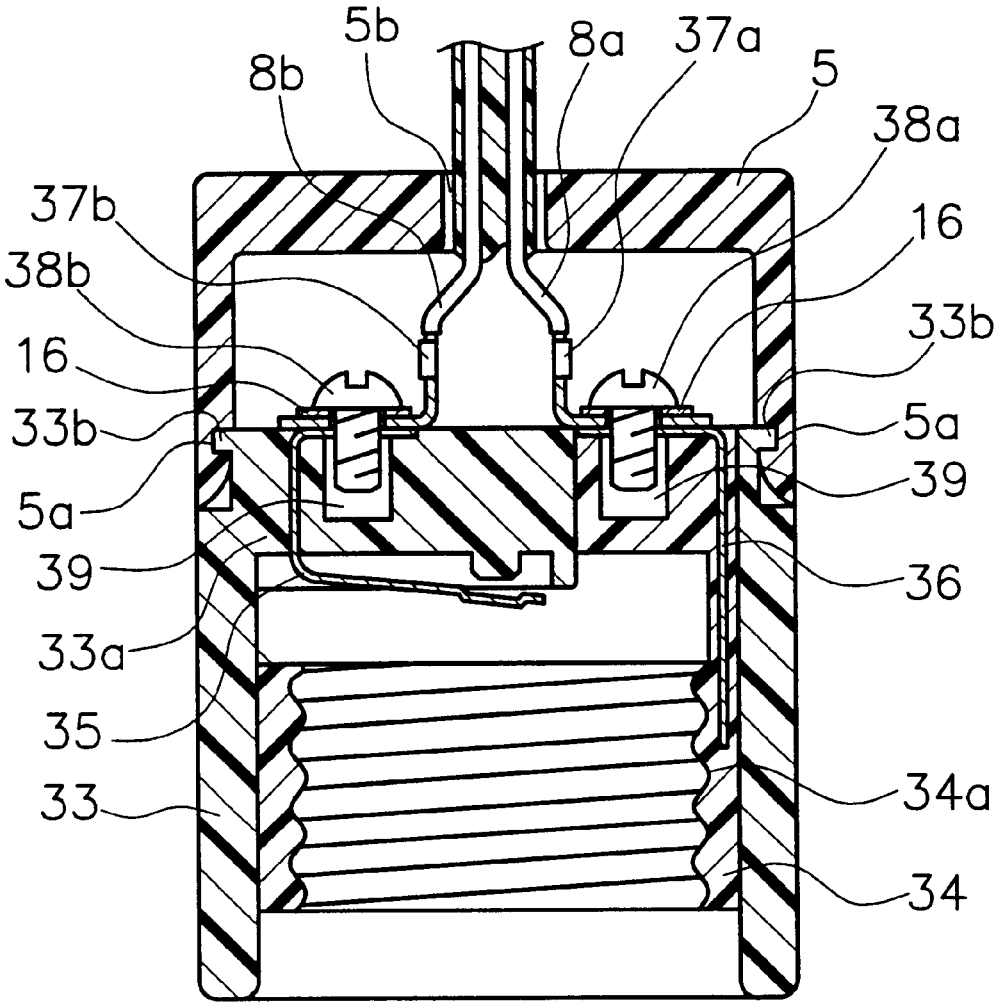
FIG. 7 is a cross-sectional front view showing a lampholder of Embodiment 7 of the present invention.

Next, a lampholder of Embodiment 7 of the present invention includes a body 33, a first terminal 34, a central contact spring 35, and a cover 5, as shown in FIG. 7. The body 33 is made of insulating resin and is in the form of a cylinder with the bottom, having a total length of 35 mm, outer diameter of 35 mm, and inner diameter of 30 mm. The first terminal 34 is made of conductive resin and provided on the inner surface of the body 33. Also, the first terminal 34 has an internal thread 34*a* on the inner surface, into which a shell (not shown) of a cap (not shown), having an external thread, is screwed to establish the electrical connection between them. The central contact spring 35 is made of copper or brass, has an L shape, length of 25 mm, width of 5 mm to 7 mm, thickness of 0.2 mm to 1.0 mm, and is connected electrically to an eyelet (not shown) at the end of the cap. The cover 5 has a height of 15 mm and outer diameter of 35 mm, and is provided on the side of a bottom 33*a* of the body 33.

The body 33 and the first terminal 34 are formed as an integral component.

The cover 5 is connected to the body 33 by engaging a concavity 5*a* at the end of the cover 5 with a convexity 33*b* at the bottom 33*a* of the body 33.

A metallic terminal 36 in the form of a plate having a length of 25 mm, width of 5 mm to 7 mm, and thickness of 0.1 mm to 1.0 mm is embedded in the first terminal 34 to establish the electrical connection between them. The length of the embedded portion of the metallic terminal 36 is 18 mm. A pressure connector 37*a,* connected to a lead wire 8*a,* is fastened and electrically connected to the metallic terminal 36 with a fastener 38*a* composed of a screw.

The bottom 33*a* of the body 33 holds the central contact spring 35, which penetrates the bottom 33*a.* A pressure connector 37*b,* connected to a lead wire 8*b,* is fastened and electrically connected to the central contact spring 35 with a fastener 38*b* composed of a screw.

In FIG. 7, reference numeral 39 indicates a hole for screws.

Unlike a conventional lampholder, the above configuration of a lampholder of Embodiment 7 of the present invention eliminates the need to fasten the component of resin or ceramic, such as a body, and that of metal, such as a female screw shell, together. Therefore, many screws or the like are not necessary. As a result, the parts and the steps of tightening the screws or the like can be reduced, compared with the conventional lampholder. Thus, the reduction of cost as well as the improvement of productivity can be achieved. In addition, the central contact spring 35 of metal is used to make the electrical connection with an eyelet, thereby decreasing contact failure and increasing reliability. Moreover, the lead wires 8*a,* 8*b* can be removed from the lampholder easily, which facilitates the replacement of damaged parts caused, e.g., by disconnection of the lead wires 8*a,* 8*b.*

Embodiment 8

Figure 8:
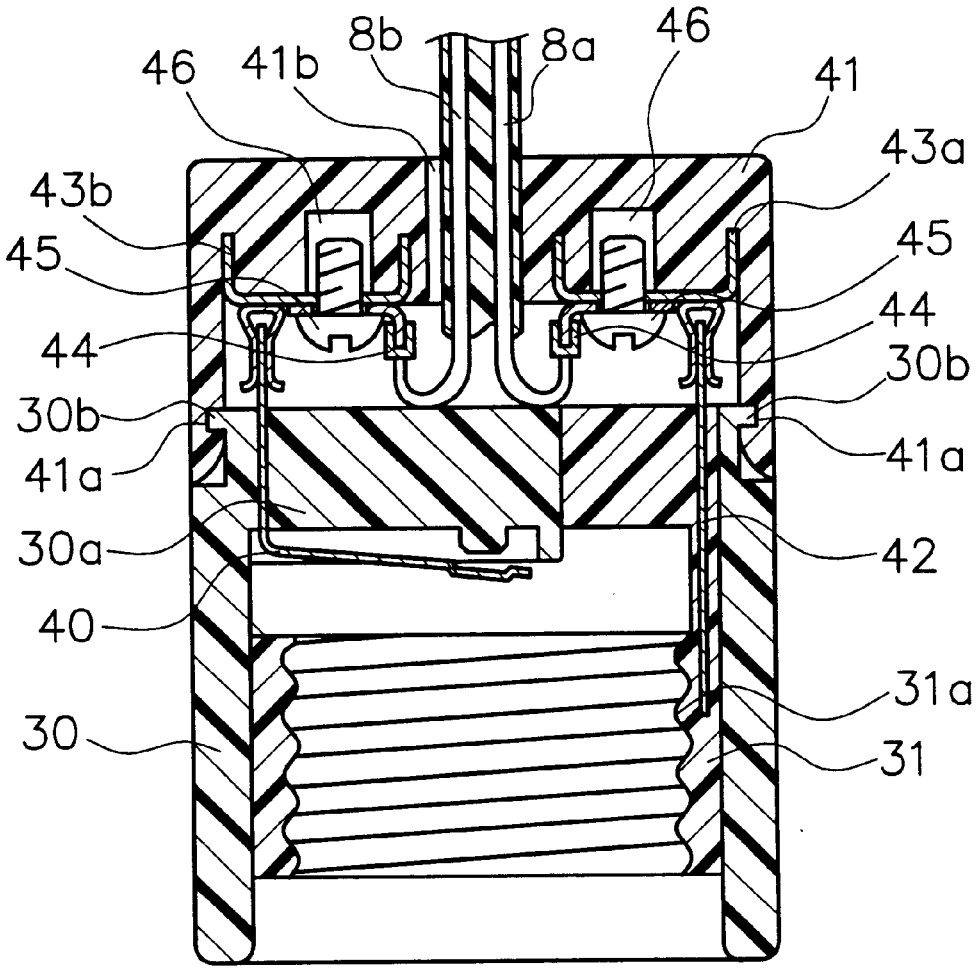
FIG. 8 is a cross-sectional front view showing a lampholder of Embodiment 8 of the present invention.
Figure 9:
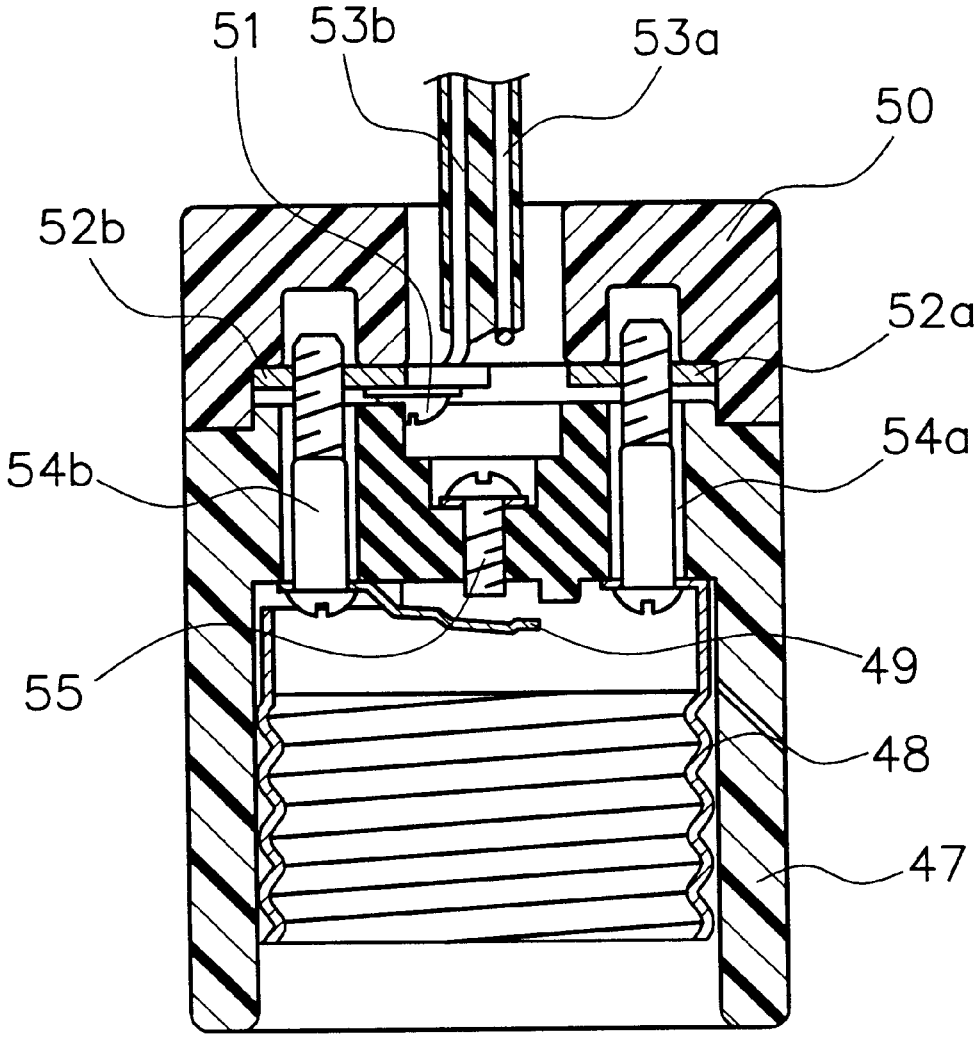
FIG. 9 PRIOR ART
FIG. 9 is a cross-sectional front view showing a conventional lamp holder.

Next, a lampholder of Embodiment 8 of the present invention includes a body 30, a first terminal 31, a central contact spring 40, and a cover 41, as shown in FIG. 8. The body 30 is made of insulating resin and is in the form of a cylinder with the bottom. The first terminal 31 is made of conductive resin and provided on the inner surface of the body 30. Also, the first terminal 31 has an internal thread 31*a* on the inner surface, into which a shell (not shown) of a cap (not shown), having an external thread, is screwed to establish the electrical connection between them. The central contact spring 40 is made of copper or brass, has an L shape, length of 30 mm, width of 5 mm to 7 mm, and thickness of 0.2 mm to 1.0 mm, and is connected electrically to an eyelet (not shown) at the end of the cap. The cover 41 has a height of 15 mm and outer diameter of 30 mm, and is provided on a bottom 30*a* of the body 30.

The body 30 and the first terminal 31 are formed as an integral component.

The body 30 is connected to the cover 41 by engaging a convexity 30*b* at the bottom 30*a* of the body 30 with a concavity 41*a* at the end of the cover 41.

A metallic terminal 42 in the form of a plate having a length of 27 mm, width of 5 mm to 7 mm, and thickness of 0.1 mm to 1.0 mm is embedded in the first terminal 31 to establish the electrical connection between them. The length of the embedded portion of the metallic terminal 42 is 20 mm.

The bottom 30*a* of the body 30 holds the central contact spring 40, which penetrates the bottom 30*a*.

Two clip terminals 43*a,* 43*b* are embedded in the cover 41 on the inner surface thereof. One clip terminal 43*a* clips the end of the metallic terminal 42. Similarly, the other clip terminal 43*b* clips the end of the central contact spring 40.

Each of two lead wires 8*a,* 8*b,* drawn from a hole 41*b* in the center of the cover 41 to the outside of the lampholder, has a pressure connector 44 at the end thereof. The pressure connectors 44 are connected electrically to the clip terminals 43*a,* 43*b,* respectively, e.g., by screws 45 or the like.

In FIG. 8, reference numeral 46 indicates a hole for screws.

Unlike a conventional lampholder, the above configuration of a lampholder of Embodiment 8 of the present invention eliminates the need to fasten the component of resin or ceramic, such as a body, and that of metal, such as a female screw shell, together. Therefore, many screws or the like are not necessary. As a result, the parts and the steps of tightening the screws or the like can be reduced, compared with the conventional lampholder. Thus, the reduction of cost as well as the improvement of productivity can be achieved. In addition, the central contact spring 40 of metal is used to make the electrical connection with the eyelet, thereby decreasing contact failure and increasing reliability. Moreover, the first terminal 31 and the central contact spring 40 can be connected electrically to the lead wires 8*a,* 8*b* easily.

As described in each of the embodiments, the receiving portions 4, 10, and 20 to be connected to a cap, including the first terminals 6, 11, 22, 31, and 34 and the second terminals 7, 12, and 23, are made of conductive resin. Thus, compared with the conventional one made of metal, various means for connecting, e.g., the receiving portion to the lead wires 8*a,* 8*b* can be employed. This can facilitate handling and prevent corrosion, such as rust.

In the above embodiments, the lampholder for the E-type cap 2 of the bulb-shaped fluorescent lamp 1 is described. However, the present invention can be applied to the E-type cap or B-type cap of a general incandescent lamp, a high-pressure discharge lamp, or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A lampholder adapted for receiving a lamp cap with a shell having an external thread, comprising:

a body made of insulating resin;

a receiving portion provided in the body, the receiving portion being made of conductive resin and comprising a first terminal made of conductive resin, the receiving portion further comprising an internal thread to be connected to the external thread of the shell; and a lead wire connected to the receiving portion for supplying electricity to the cap through the receiving portion;

wherein the body and the receiving portion are formed as an integral component.

2. The lampholder according to claim 1, adapted for receiving a cap having an eyelet at the end, wherein the receiving portion is provided with a second terminal that is made of conductive resin and to be connected to the eyelet.

3. The lampholder according to claim 1, adapted for receiving a cap having an eyelet at the end, wherein the body holds a central contact spring that is made of metal and to be connected to the eyelet.

4. The lampholder according to claim 1, wherein the lead wire is embedded in the receiving portion to make a connection therebetween.

5. The lampholder according to claim 1, wherein the lead wire is connected to the receiving portion by a fastener.

6. The lampholder according to claim 1, wherein the lead wire is connected to the receiving portion via a metallic terminal embedded in the receiving portion.

7. The lampholder according to claim 1, wherein the lead wire is connected to a clip terminal, and the clip terminal clips a metallic terminal connected to the receiving portion.

* * * * *